United States Patent [19]

Kasamura

[11] 4,389,046

[45] Jun. 21, 1983

[54] SHEET FEEDING MECHANISM FOR IMAGE FORMING APPARATUS

[75] Inventor: Toshirou Kasamura, Yokohama, Japan

[73] Assignee: Canon Kabushiki Kaisha, Tokyo, Japan

[21] Appl. No.: 208,041

[22] Filed: Nov. 18, 1980

[30] Foreign Application Priority Data

Nov. 26, 1979 [JP] Japan ..... 54-152623

[51] Int. Cl.[3] ..... B65H 7/02

[52] U.S. Cl. ..... 271/227; 271/245

[58] Field of Search ..... 271/227, 244, 245, 246

[56] References Cited

U.S. PATENT DOCUMENTS 3,095,192 6/1963 Simjian ..... 271/246

3,545,743 12/1970 Limberger ..... 271/227

4,025,187 5/1977 Taylor ..... 271/245 X

*Primary Examiner*—Richard A. Schacher

*Attorney, Agent, or Firm*—Fitzpatrick, Cella, Harper & Scinto

[57] ABSTRACT

The present invention provides a sheet feeding mechanism for high-speed sheet feeding in succession at exact timing. The mechanism has output signal generating device for generating reference signals for sheet feeding, control device for releasing a rotary member from stopped state in response to the reference signal, an eccentric cam driven by the rotary member when it is in the rotation state and a rocking member to be driven by the eccentric cam, an end portion of rocking member for stopping the sheet material being positioned at the upstream or downstream side of constantly rotated members such as paired rollers in the sheet feed path to control the sheet feed timing by the rocking motion of said end portion of the rocking member.

2 Claims, 6 Drawing Figures

SHEET FEEDING MECHANISM FOR IMAGE FORMING APPARATUS

BACKGROUND OF THE INVENTION

1. Field of the Invention

The present invention relates to a sheet feed mechanism for feeding sheet materials to a determined position with exact timing and at a high speed, and more particularly to a feed mechanism for feeding image-receiving sheets such as plain paper, insulating paper or chargeable paper in synchronization with a toner image or an electrostatic image formed on an image bearing member such as a photosensitive member or an insulating member, or an original feeding mechanism for feeding sheet originals in succession to an original exposure position.

2. Description of the Prior Art

In recent years, the electrophotographic copiers have been developed toward high-speed duplicators to meet certain market requirements. Such high-speed copying has been confronted technically by mechanical problems resulting high-speed drive of original scanning optical system for high-speed repetitive formation of electrostatic latent image, limitation in copying speed resulting from the photosensitivity of the photosensitive member, increase in power consumption for corona discharge and original illuminating lamp for repetitive latent image formation etc. In order to overcome these difficulties have been developed copiers in which the optical system is fixed, and those in which an electrostatic latent image is repeatedly utilized for image reproduction.

In the following description, the present invention will be explained with reference to the feed mechanism for image receiving sheets for such high-speed copier.

Particularly the above-mentioned copier repeatedly utilizing the latent image is capable of sufficiently elevating the image forming speed since the latent image forming means are utilized only in the first latent image formation and the image reproduction can be conducted regardless of the original scanning speed or the sensitivity of the photosensitive member. Such copier for example utilizes the latent image transfer process or the ion flow modulation process. However, once the high-speed processing in the development step or in the latent image forming step is resolved as explained in the foregoing, there emerges a difficulty in the feeding of image receiving sheets for receiving thus formed images.

The above-mentioned difficulty lies principally in achieving exact positional registration of the image on the image bearing member and the image receiving sheet under high-speed operation. Conventionally such registration is achieved by matching the leading end of the image bearing member with the leading end of the image receiving sheet. More specifically the original image is formed at a reference position on the image bearing member, and the image receiving sheet is advanced so as to meet said reference position. Said advancement is controlled for example by solenoid clutches which are controlled by electric signals from a control unit and which is turn control the sheet feed rollers and registers rollers for final position control. However, in such high-speed apparatus as explained above, the above-mentioned drive system is significantly affected by functional errors resulting from the abrasion of clutches caused by the inertia and repetitive on-off motions of the feed rollers. In addition to the abrasion, the clutches generate heat, thus becoming unable to perform exact functions in response to the input signals and giving rise to aberrared sheet feed timing. Also repeated on-off motions at high speed apply a significant load to clutches unbalanced to the solenoid power, thus shortening the service life thereof.

Also such positional registration is achievable by storing an electric signal indicating the reference position of the original image with respect to the image bearing member in a memory for image-receiving sheet feeding, then activating a control mechanism for a register member by the electric signal from said memory at the start of the sheet feeding, and automatically conducting sheet feeding thereafter mechanically by means of said control mechanism. However, also in such system, the data entry into and data reading from said memory are inevitably associated with certain errors, leading thus to incorrect registration of the image position on the bearing member and the image receiving sheet.

SUMMARY OF THE INVENTION

In consideration of the aforementioned difficulties, the object of the present invention is to provide a sheet feed control mechanism adapted for use in a high-speed apparatus.

Another object of the present invention is to provide a control mechanism capable of achieving lower noise level and stable function not achievable in the conventional mechanism.

According to the present invention, the foregoing objects are achieved by a sheet feed mechanism comprising output signal generating means for generating signal for operating the feed mechanism, control means for releasing a rotary member from a stopped state in response to said signal, an eccentric cam to be driven by said rotary member when it is in the rotated state, and a rocking member to be driven by said eccentric cam, said rocking member being provided with an end stopping portion for sheet material to be positioned, in the sheet feed path, at the upstream or downstream side of paired rollers or at the upstream side of paired belts constantly driven in the sheet feed direction.

In case said sheet material is an image receiving sheet for receiving a toner image from an image bearing member such as a photosensitive member, the signals from said signal generating means are generated at such timings that said sheet material is advanced in registration with the position of toner image on the image bearing member. Also in case said sheet material is an original, said signals are generated at such timings that said original is exposed to a determined position on the photosensitive member.

DESCRIPTION OF THE PREFERRED EMBODIMENTS

Figure 1:
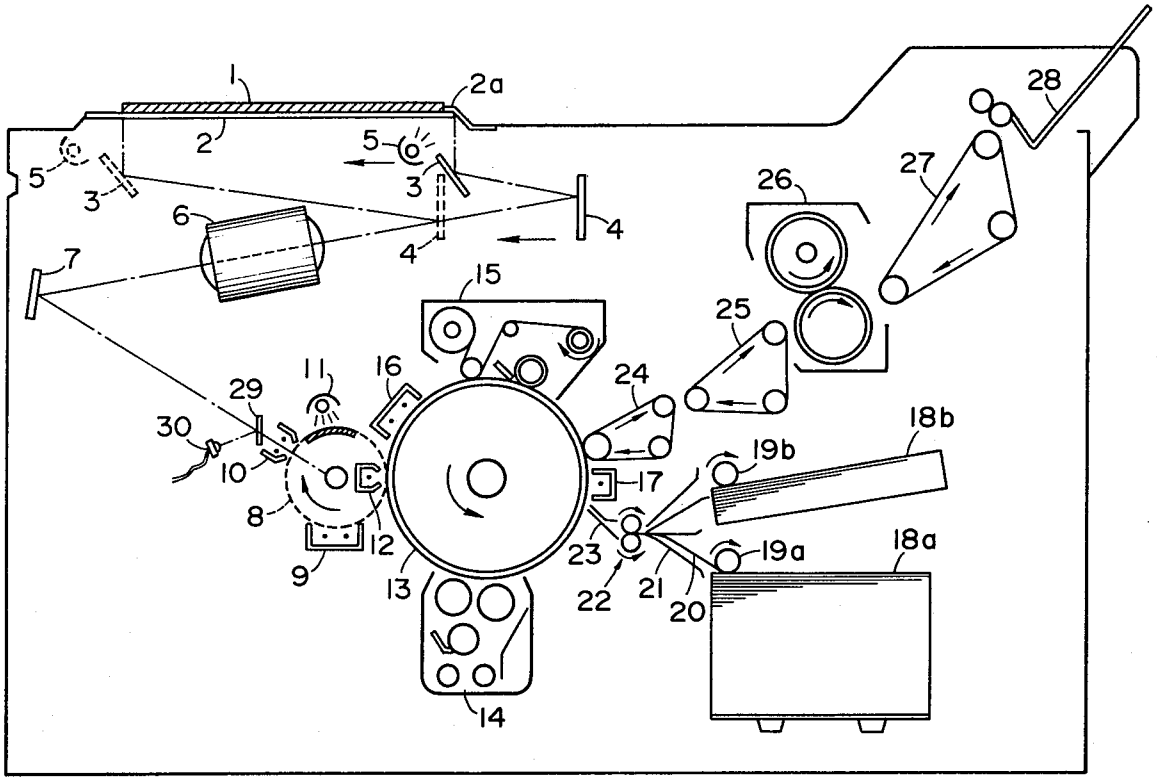
FIG. 1 is a schematic cross-sectional view of a copier in which the present invention is applied in the feed timing control or image-receiving sheets.

The rocking member employed in the present invention substantially functions as a registering member for the sheet material, capable of automatically achieving exact registration of the sheet material with respect to the image bearing member without requiring activation of other means such as solenoid clutch for each sheet feeding. Also in contrast to the conventional mechanism in which the initial signal is once stored in a memory and then revived at regular intervals for achieving registration, the mechanism of the present invention, only requiring the initial signal itself for driving the registering member, is therefore made simpler and is completely free from the errors in the sheet feeding resulting from the timing errors in the revived signals.

Also the successive feed of plural sheets is achieved by plural rotations of the rotary member. The rotary member is provided on the rotary shaft thereof with known one-turn clutch means which automatically terminates the rotation of the rotary member after one full turn, and in case of successive sheet feeding the period of rotation of the rotary member is controlled by disengaging a clutch stopping member from said clutch means. In case the sheet material is an image receiving sheet, the signal for initiating the rotation of said shaft may be obtained from suitable means capable of generating a reference signal indicating the image position on the image bearing member. Said signal can be applied to a plunger for disengaging the stop member from said rotary clutch means to initiate the rotation of said shaft, and, in a high-speed apparatus, the revolution of said shaft is preferably selected for the purpose of precise control in such a manner that the registering member is actuated once every turn. The combination between a member rotating or displacing in relation to the rotation of said shaft and the registering member can be achieved by a suitable mechanism securely transmitting the motion such as the combination of an eccentric cam and a rocking plate following said cam. More specifically there may be employed an eccentric cam mounted on said shaft and a registering member performing reciprocating motion by means of a rocking plate following said cam.

The mechanism of the present invention, being free from the use of clutch for each start and stop of the register roller as in the conventional mechanism, does not cause the clutch noise at each rotation of the register roller nor is associated with the troubles resulting from the clutch. Also in the mechanism in which the start of rotation of said shaft is controlled by said electric signal, mechanical adjustment for synchronizing the sheet material with the image bearing member is unnecessary not only at the production stage but also in the field maintenance. Furthermore the present invention, allowing to minimize the number of abrading parts such as said clutch, is advantageous in dispensing with the repair or adjustment resulting from the abrasion or replacement of parts even after prolonged use in the market.

Now the present invention will be clarified in detail by a feed control mechanism for image receiving sheets for a high-speed electrophotographic copier, wherein the "high-speed" copying corresponds to the feeding of at least 40 sheets, particularly 60 to 200 sheets, of JIS A4 size (210×297 mm) of which shorter side is arranged in the feed direction.

FIG. 1 shows, in a lateral view, a high-speed copier utilizing the ion modulation process already disclosed by the present applicant for latent image formation, in which the present invention is applied. An original 1 to be copied is placed on a glass plate 2 constituting an original carriage. For the purpose of scanning said original carriage there is employed a known optical system provided with a first mirror 3 and a second mirror 4 displaced at a speed ratio of 2:1, said first mirror 3 being structured integrally with an original illuminating lamp. The light reflected from said original is introduced through said first and second mirrors to a lens 6, and further guided through a fixed mirror 7 to a photosensitive screen member 8. Said photosensitive member 8 is provided with minute apertures for modulating ion flow, and is formed as a drum composed of a conductive substrate, a photoconductive layer and a surfacial insulating layer in the order from the inside to the outside and rotated in the direction indicated by the arrow. A primary latent image is formed on said photosensitive member 8 by uniformly charging said member 8 with a primary corona discharger 9, then exposing said member 8 to the original image simultaneously with a secondary charging of a polarity opposite to that of said primary charging by means of a secondary corona discharger 10, and uniformly irradiating said member 8 with a flush exposure lamp 11. A secondary latent image is newly formed on an insulating drum 13 by controlling the passage of corona ion flow from a corona discharger 12 by means of the electric field formed in said minute apertures of the member 8 by means of said primary latent image.

In the above-explained latent image formation process, since the modulating electric field is formed on the surfacial insulating layer, the primary latent image is little attenuated even after plural modulations and is thus capable of providing secondary latent images several tens to several hundreds of times if the photosensitive member is suitably structured. Thus, although the primary latent image formation speed is governed by the displacing speed of the optical system and the sensitivity of the photosensitive member, the secondary latent image formation can be realized at a speed two to five times faster than the primary latent image formation. Also the above-explained latent image formation process is economical in power consumption as the means employed in the primary latent image formation are not necessary in the secondary latent image formation.

The secondary latent image on said insulating drum 13 is rendered visible in developing means 14 and is subjected to a transfer step to be explained later, and said drum 13 is treated by cleaning means 15 for removing the remaining developer and is subjected to a uniform charge elimination by a corona discharger 16 before entering the succeeding secondary latent image formation cycle. The toner image formed on said durm 13 is transferred, in the transfer station, by means of a bias potential supplied by a corona discharger 17 onto a plain image-receiving sheet advanced in synchronization with said toner image. Said image-receiving sheet is stacked in a main cassette **18*a* and an auxiliary cassette 18*b* and sheetwise supplied to said transfer station selectively by means of feed rollers 19***a*, 19*b*. The supplied image-receiving sheet 20 is guided by a guide plate 21 and reaches constantly drive paired feed rollers 22. A member (not shown) provided at the cassette side of said paired rollers is intermittently actuated to advance said sheet 20 towards the drum 13 through said rollers 22 in synchronization with the toner image on said insulating drum 13. The sheet 20 advanced by said rollers 22 is guided along a guide plate 23 to reach the drum 13. After the transfer of the toner image by the discharger 17 as explained above, the image-receiving sheet 20 is forcedly separated from said drum 13 by means of an unrepresented separating means, and further guided through first and second suction conveyor belts 24, 25, heat-roller fixing means 26, and a third conveyor belt 27 onto a tray 28.

In the above-explained copier plural secondary latent images can be formed from a single primary latent image due to the particular structure of the photosensitive member as explained in the foregoing. Thus, once the primary latent image is formed, the photosensitive member 8 is rotated at a high speed to from the secondary latent images in succession. Also the feed rollers 19 are intermittently driven in synchronization with the toner images developed from said secondary latent images, and the unrepresented registering member provided in the vicinity of the feed roller 22 is activated to advance the image-receiving sheets 20 to the insulating drum 13 in synchronization with said developed images to achieve high-speed copying.

In the following there will be given a detailed explanation on the sheet feed control mechanism applicable in the above-explained copier while making reference to FIGS. 2 to 6, in which FIGS. 2 and 3 respectively show said mechanism in a detailed lateral view and a plan view. Said mechanism is adapted, in case of continuous copying in the above-explained copier, to detect the leading end of the original image as a reference point for registering the image-receiving sheet with said original image and to cause intermittent function of said registering member during a period required for advancing a necessary number of sheets in response to the information obtained from said positional detection and without the use of clutches.

The leading end of said original image is detected by a black detection pattern provided at an end portion 2*a* of the glass plate 2 substantially corresponding to the leading end of the original 1, said pattern being detected by the optical system during the scanning motion thereof. Said pattern is reflected by a half-mirror 29 provided in front of the secondary discharger 10 and is detected by a photoconductive element 30 which generates a detection signal upon said detection. Naturally said detection pattern may be replaced by various known methods such as a mechanism for detecting the position of the first mirror 3, and the present invention is by no means limited to the leading end detecting method employed in the present embodiment.

The detection signal thus generated causes the energization of a solenoid SL for a determined period, whereby a rocking arm 31 is rotated in the direction of arrow A about a shaft 32 and a claw 33 provided on said arm 31 is retracted from a recess 35 of a one-turn clutch 34 and is maintained in the illustrated state. The shaft 36 of said clutch 34 is so structured as to be rotated at the same speed as the photosensitive member 8 whereby said shaft 36 performs a full turn during a full turn of the photosensitive member 8. Said one-turn clutch 34 mounted on said shaft 36 is of a spring friction type and is rotated in the direction of arrow together with said shaft 36 only during the absence of rotational resistance. A first gear 37 is mounted on the rotating part of said clutch 34 and is rotated therewith in the direction of arrow. Thus said gear continues rotation until the claw 33 disengaged from the recess 35 becomes again engages with said recess 35 under the biasing force of a spring 47 after the deactivation of the solenoid SL, and the rotation of said first gear 37 is transmitted to a second gear 38 having a same number to teeth as that of said first gear 37.

Said second gear 38 is provided on the shaft 39 thereof with an eccentric cam 40 to rotate said cam in the direction of arrow at the same speed as said gears. Consequently said cam 40 performs a full turn during a full turn of the photosensitive member 8. Said eccentric cam 40 is constantly maintained in contact with a roller 41 which is rotatably supported on a roller shaft 42 of a rocking plate 43, which in turn is supported by a shaft 46 to perform rocking motion as indicated by the arrow according to the position of the roller 41. Said rocking plate 43 is provided at the other end thereof with a spring 44 to bias said rocking plate anticlockwise. Thus the roller 41 is constantly maintained in contact with the periphery of said eccentric cam 40 to cause rocking motion of the rocking plate 43 as represented by the arrow along the rotation of said eccentric cam 40.

Consequently the rocking plate 43 performs a rocking cycle during a full turn of the eccentric cam 40 or of the photosensitive member 8. A registering member 45 is mounted on said shaft 46 to perform rocking motion as represented by the arrow C according to the rocking motion of said rocking plate 43. In this manner said registering member 45 performs a rocking cycle during a full turn of the photosensitive member.

The feeding of the image receiving sheet in the above-explained mechanism is achieved in the following manner.

Figure 2:
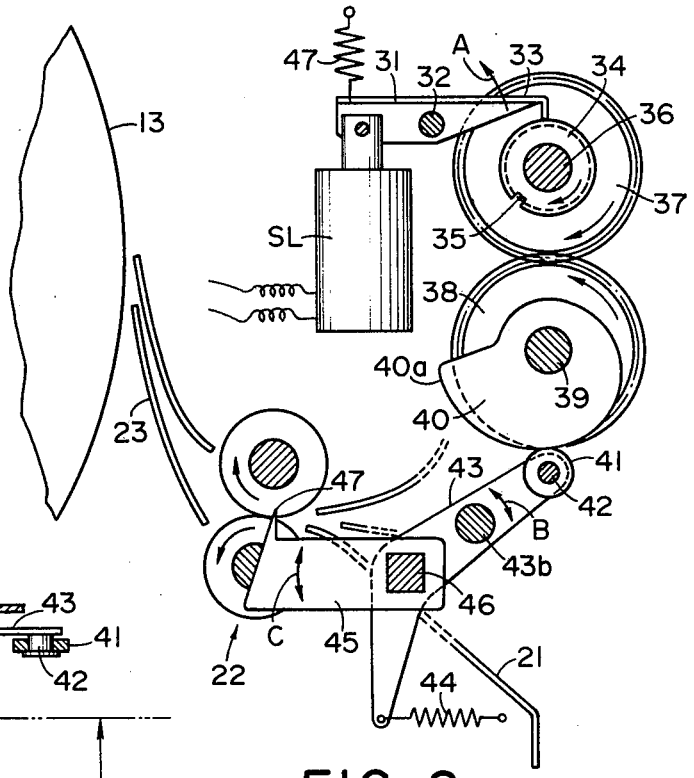
FIG. 2 is a cross-sectional view of the control mechanism of the present invention.

At first, in response to the aforementioned detection signal obtained at the detection of the leading end of the original image, the solenoid SL is energized to cause the rotation of the eccentric cam 40 in the above-explained manner, whereby the registering member 45 is displaced upwards from the position shown in FIG. 2. The image receiving sheet advanced by the feed roller 19*a* or 19*b* is maintained in a stand-by position, forming a loop while the leading end in the advancing direction is stopped by an end claw 47 of said registering member 45. When a protruding portion 40*a* of said eccentric cam passes through the position of said roller 41, the registering member 45 is rotated anticlockwise, whereby the leading end of the image receiving sheet is released from said claw 47 and is transported towards the drum 13 through constantly rotated feed rollers 22 securely and at an exact timing.

Said rocking registering member may also be structured to stop the image receiving sheet with a descending claw in place of the ascending claw as shown in FIG. 2. In such case the eccentric cam 40 may be provided with an inverted structure wherein the recessed portion of said cam corresponds to the stopped state of said image receiving sheet.

The feed timing of the second sheet and thereafer is automatically determined by the rotation of the eccentric cam, and said solenoid SL is continuously energized during the feeding of a required number of sheets and neet not be controlled for each sheet feeding. The solenoid SL is deactivated when the last sheet is fed to complete the feeding operation. However the clutch 34 naturally continues rotation until the claw 33 becomes engaged with the recess 35 and is therefore stopped as a position indentical with the initial position.

Figure 3:
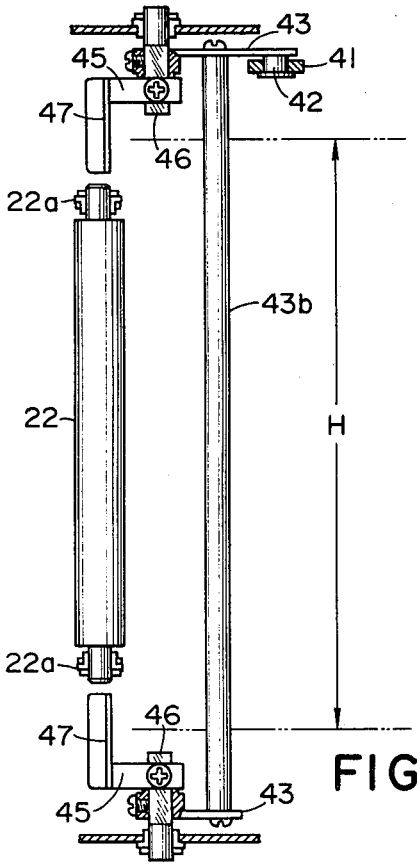
FIG. 3 is a plan view of and around the registering member shown in FIG. 2.

FIG. 3 shows the mechanism of FIG. 2 in a plan view seen from above the registering member, wherein the upper one of the rollers 22 and the guide plate for image receiving sheet are removed for the purpose of clarity. In FIG. 3, an arrow H indicates the transport width of the image receiving sheet, while 43*b* is a rod connecting the rocking plates 43 on both sides. Bearings 22*a* for the roller 22 are supported by side plates which are extended from below so as not to interfere with the transportation of the image receiving sheet. In this manner the roller 41 causes the rocking motion of the rocking plates on both sides, thus inserting the claws 47 into the transport path of the sheet.

Figure 4:
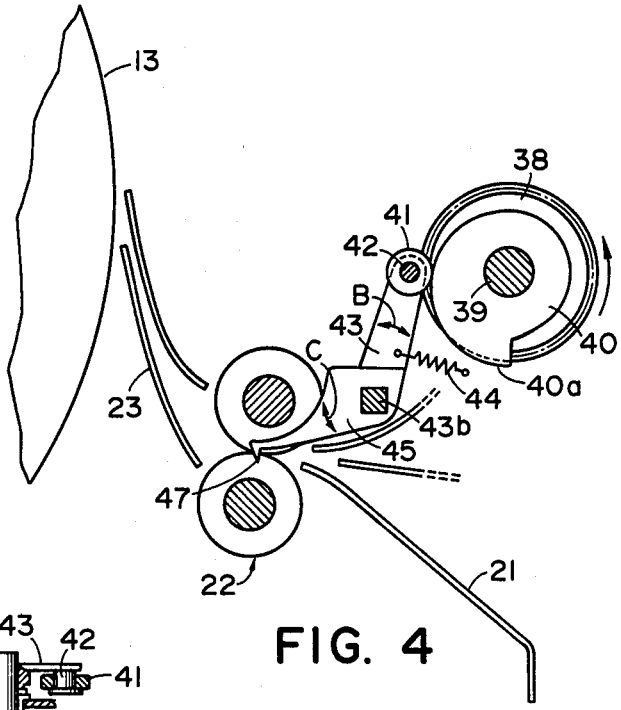
FIG. 4 is a cross-sectional view of and around the registering member showing a variation of the present invention.
Figure 5:
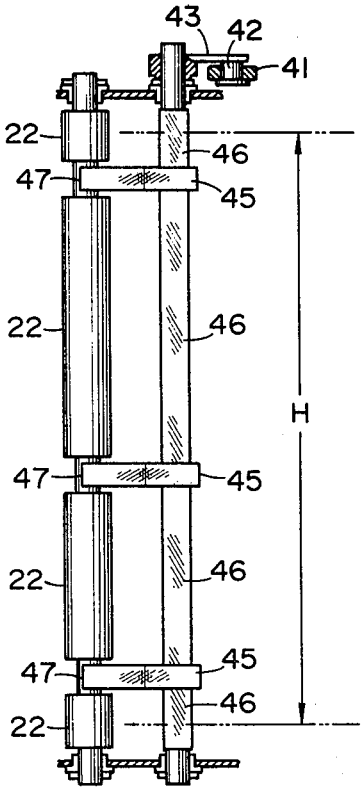
FIG. 5 is a plan view of and around the registering member shown in FIG. 4.

As a variation to the mechanism shown in FIG. 2, it is also possible to mount the eccentric cam on the shaft 36 or to adopt a modified shape in the eccentric cam 40 so as to register ½, 2 or 3 sheets during a full turn of said cam 40. Furthermore the claw 47 of the registering member 45 may be positioned at the downstream side of the constantly rotated feed rollers 22 as shown in FIG. 4, in which case the image receiving sheet is supported in slipping state between the feed rollers 22 while the leading end of said sheet is stopped by the claw 47 of the registering member 45. In FIG. 4, the members substantially corresponding to those in FIG. 2 are represented by the numbers same as those in FIG. 2. FIG. 5 shows the mechanism of FIG. 4 in a plan view, in which the rollers 22 are lower ones of the paired rollers. The claws 47 are received by the slot portions of said rollers 22, and the rocking shaft 46 is directly driven by the rocking plate 43.

Figure 6:
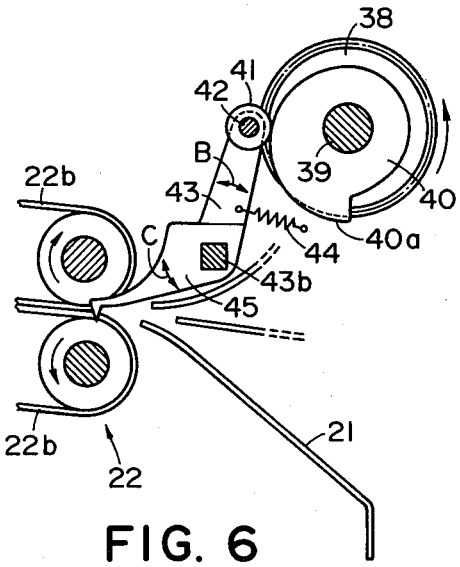
FIG. 6 is a cross-sectional view of and around the registering member showing a variation of the present invention.

FIG. 6 is a lateral view of the registering mechanism in which the paired rollers 22 shown in FIG. 4 are replaced by conveyor belts, in which case the image receiving sheet is stopped at the entrance of mutually facing conveyor belts while the leading end of said sheet is maintained in slipping relation with said belts.

As explained in the foregoing, the mechanism of the present invention, being free from the on-off function of the solenoids and clutches required for each sheet feeding in the prior technology, allows to avoid the errors in clutch function resulting from abrasion of friction faces of the clutch and from clutch heating caused by repetitive functions thereof, the errors in sheet feed timing control resulting from such errors in clutch function, and the noise caused by repetitive functions of the clutches and solenoids. According to the present invention, in case said sheet material is an image receiving sheet, the solenoid needs to be actuated only once in response to a signal obtained at the detection of the original position, and the sheet feeding thereafter can be automatically controlled in mechanical manner at an exactly same interval. Also in case said sheet meterial is an original, the solenoid needs to be actuated only once in a similar manner in response to a signal indicating that the latent image forming means are ready and the photosensitive member is in position. The mechanism of the present invention, being provided with a minimum number of mechanically abrading components, is capable of maintaining highly reliable sheet feed control over a prolonged period. This is achieved, as explained in the foregoing, by energizing the solenoid directly by a timing signal and thereafter continuing the sheet feeding by means of the above-explained structure for mechanical timing control without the use of any memory means or signal generating means. In this manner it is rendered possible to achieve stable and secure sheet registration, not affected by the errors in the signals or in the function of various means for receiving such signals.

The present invention is by no means limited to the foregoing embodiment, and it will be evident that the detecting method for original position by means of an optical element as described in the foregoing embodiment can be easily replaced by a known method for detecting a particular position of the photosensitive member, for example by a microswitch provided in a part of the displacing optical system, for example at a scanning mirror. Furthermore the present invention may be modified as a mechanism for feeding chargeable sheets such as insulating sheets directly to a photosensitive screen or to a laminar-structured photosensitive member, or as a sheet feed mechanism for a printing or recording apparatus.

What I claim is:

1. In an apparatus wherein an image forming process is repeated at a regular cycle for forming images of an original, an improvement including a mechanism for feeding copy sheets at regular intervals, said mechanism comprising:

first detecting means for detecting a position of an original to generate a signal to register the original and the sheet;

second detecting means for detecting the feeding of a last said sheet to be fed out;

a cam member continuously rotatable at the speed of said cycle;

a repeatedly operable timing member, responsive to said cam member, for stopping and releasing the sheets along a sheet conveying path at a predetermined position according to said cycle to feed the sheets in a timed relation; and a control member movable between a first position wherein said cam member, in response to an initial signal produced by said first detecting means, is allowed to rotate continuously, and a second position wherein said cam member, in response to the signal produced by said second detecting means, is stopped.

2. A mechanism according to claim 1, wherein said timing member comprises a timing pawl and a cam follower integral with said timing pawl and directly driven by said cam member.

* * * * *

UNITED STATES PATENT AND TRADEMARK OFFICE

CERTIFICATE OF CORRECTION

PATENT NO. : 4,389,046

DATED : June 21, 1983

INVENTOR(S) : TOSHIROU KASAMURA

It is certified that error appears in the above—identified patent and that said Letters Patent is hereby corrected as shown below:

COLUMN 1

Line 23, after "resulting" insert --from--.

Line 24, change "system" to read -- systems--.

Line 25, change "image," to read --images,--.

Line 36, change "copier" to read --copiers--.

Line 63, change "is" to read --in--.

Line 64, change "registers" to read --register--.

COLUMN 2

Line 4, change "aberrared" to read --aberrant--.

Line 36, before "signal" insert --a--.

Line 52, after "of" insert --a--.

COLUMN 4

Line 4, after "which" insert --the--.

Line 62, change "durm" to read --drum--.

UNITED STATES PATENT AND TRADEMARK OFFICE

CERTIFICATE OF CORRECTION

PATENT NO. : 4,389,046

DATED : June 21, 1983

INVENTOR(S) : TOSHIROU KASAMURA

It is certified that error appears in the above—identified patent and that said Letters Patent is hereby corrected as shown below:

COLUMN 5

Line 3, change "drive" to read --driven--.

Line 22, change "from" to read --form--.

Line 32, change "on" to read --of--.

COLUMN 6

Line 8, change "engages" to read --engaged--.

Line 11, change "to" to read --of--.

Line 64, change "thereafer" to read --thereafter--.

Line 68, change "neet" to read --need--.

UNITED STATES PATENT AND TRADEMARK OFFICE

CERTIFICATE OF CORRECTION

PATENT NO. : 4,389,046

DATED : June 21, 1983

INVENTOR(S) : TOSHIROU KASAMURA

It is certified that error appears in the above—identified patent and that said Letters Patent is hereby corrected as shown below:

COLUMN 7

Line 4, change "as" to read --at--.

Line 8, after "for" insert --the--.

Signed and Sealed this

*Twenty-seventh* Day of *March 1984*

[SEAL]

*Attest:*

GERALD J. MOSSINGHOFF

*Attesting Officer*

*Commissioner of Patents and Trademarks*